US006216749B1

(12) United States Patent
Kutzleb et al.

(10) Patent No.: US 6,216,749 B1
(45) Date of Patent: Apr. 17, 2001

(54) WEAVING DEVICE

(75) Inventors: Chester F. Kutzleb, Sagle; Roger King, Sandpoint; Anders Bostrom, Sandpoint; Robert Kellogg, Sandpoint, all of ID (US)

(73) Assignee: WIS Seaming Equipment, Inc., Sandpoint, ID (US)

( * ) Notice: Subject to any disclaimer, the term of this patent is extended or adjusted under 35 U.S.C. 154(b) by 0 days.

(21) Appl. No.: 09/458,769

(22) Filed: Dec. 10, 1999

(51) Int. Cl.[7] ..... D03C 13/00
(52) U.S. Cl. ..... 139/455; 139/59; 139/85
(58) Field of Search ..... 139/85, 455, 59

(56) References Cited

U.S. PATENT DOCUMENTS

| | | | | |
|---|---|---|---|---|
| 3,865,148 | * | 2/1975 | Wolfgang et al. | 139/59 |
| 3,918,500 | * | 11/1975 | Katsumata | 139/59 |
| 4,034,782 | * | 7/1977 | Bucher | 139/85 |
| 5,309,950 | * | 5/1994 | Bassi et al. | 139/88 |
| 5,628,347 | * | 5/1997 | Rush | 139/455 |
| 5,819,813 | * | 10/1998 | Dewispelaere | 139/455 |
| 5,839,481 | * | 11/1998 | Bassi et al. | 139/455 |
| 5,860,454 | * | 1/1999 | Mista et al. | 139/455 |
| 5,911,247 | * | 6/1999 | Waters | 139/455 |
| 6,041,831 | * | 3/2000 | Kuoni et al. | 139/55.1 |
| 6,050,302 | * | 4/2000 | Guse et al. | 139/1 R |
| 6,085,803 | * | 7/2000 | Dewispelaere | 139/455 |
| 6,105,628 | * | 8/2000 | Duhamel | 139/455 |

FOREIGN PATENT DOCUMENTS

| | | | | |
|---|---|---|---|---|
| 0292632 | * | 7/1987 | (EP) | D03C/3/44 |
| 421 370 A1 | | 4/1991 | (EP) . | |

OTHER PUBLICATIONS

Staubli AG brochure; "Name–Weaving Jacquard Machine CX 160"; undated; 6 pages.
Grosse Webereimaschinen GmbH brochure; "Electronic High Speed Jacquard–Machine EJP–3"; undated; 4 pages.

* cited by examiner

*Primary Examiner*—John J. Calvert
*Assistant Examiner*—Robert H. Muromoto, Jr.
(74) *Attorney, Agent, or Firm*—Wells, St. John, Roberts, Gregory & Matkin, P.S.

(57) ABSTRACT

A solenoid unit for a weaving device is described and which includes a frame; a plurality of eyelets mounted on the frame and individually movable with respect to the frame; a support member releasably coupled to the frame; and a plurality of solenoids mounted on the support member, and wherein each solenoid controls the movement of at least one eyelet.

41 Claims, 11 Drawing Sheets

WEAVING DEVICE

TECHNICAL FIELD

The present invention relates to a weaving device and more specifically to a modular solenoid for use with same.

BACKGROUND OF THE INVENTION

Weaving devices, commonly called looms, are known in the art and have been in existence in one or another form for thousands of years. Weaving devices are generally used for producing woven fabric. Generally speaking, weaving devices consist of a frame, a substantially horizontal array of eyelets movably supported by the frame between an upper position and a lower position, and a mechanism for moving the eyelets between the two positions.

To set up a typical weaving device for operation, a thread, or any type of weavable strand, is drawn off a spool and passed through an eyelet of the weaving device, then passed through a guide which is on the opposite side of the eyelet from the spool. The guide may be in the form of a long horizontal slot, or a gap between two horizontal, vertically opposed rollers for example. Each eyelet is threaded in this manner with an individual thread.

Selected eyelets are oriented in the upper position and slightly above the guide, while the remaining eyelets are oriented in the lower position and slightly below the guide. This difference in the relative positions of the eyelets with respect to each other and to the guide, causes the threads to form an upper and lower row of parallel threads. The upper row passes from the upper eyelets to the guide, and the lower row passes from the lower eyelets to the guide. The two rows intersect, or meet, at the guide to form an acute interior corner or angle. This formation of two rows of threads is generally called a shed. Thus, a shed can basically be described as two flat planes, each formed by a row of parallel threads, which meet to form a trough, or corner.

To begin the weaving process a cross-thread, called a weft thread, is placed into the corner of the shed where the threads meet at the guide, and perpendicular to the warp threads. After placement of the weft thread, the position of each eyelet is reversed, that is, the upper eyelets move to the lower position, and the lower eyelets move to the upper position. This change in position of the eyelets not only forms another shed, but also causes the warp threads to partially wrap around the weft thread. A second weft thread is then inserted into the corner of the new shed, and the position of each eyelet is again reversed. This process is continually repeated to form a fabric created from interlacing, or weaving, the warp and weft threads.

Basic woven fabric is produced on weaving devices which move the respective eyelets in a continuously repeating sequence of shed changes to produce a substantially homogeneous fabric pattern. However, a special type of weaving device, called a Jacquard device, may be used, for among other purposes, to weave intricate or varying patterns into the fabric, or to perform seaming operations in which the opposite edges of a piece of fabric are woven together to form an endless ribbon or belt of fabric. Jacquard devices are well known in the art and have been in existence for hundreds of years in various forms. In a Jacquard device, each eyelet is individually selectively movable with respect to each of the shed changes. In other words, the sequence of movements of the eyelets is not merely uniformly repetitive, but may be selectively variable with each shed change. In this manner, varying and stylistically appealing patterns may be woven into the fabric by the weaving device.

Generally speaking, a Jacquard weaving device consists of an array of springs mounted on the top of the frame of the weaving device. An eyelet is attached to each of the springs and depends from the lower end of the spring. The respective springs bias the eyelets toward an upper position. A pulley block is attached to the lower side of each eyelet and depends below the eyelet. A cord is fed or otherwise received through the pulley block and engages the sheave, or pulley wheel of same. The opposite ends of the cord depend from the pulley block. The cord has two hooks attached to it, one on each end.

Attached to the frame, are griff bars which reciprocally move up and down below the pulley block. The griff bars are mechanically linked together so that, as one griff bar moves up, the other correspondingly moves down, and vice versa. An actuator such as an electrical motor is coupled to one of the griff bars to reciprocally move the griff bars at continuously selective and repeating intervals.

The hooks slidably engage guides which are mounted on the frame. The respective guides restrict and direct the path of movement of the hooks such that the path of movement of one of the hooks substantially coincides with one of the griff bars, and the path of movement of the other hook substantially coincides with the other griff bar. Each hook has a slot formed therein which is engaged by the respective griff bar as it moves downwardly. If the hook is held in its lowermost position, the slot formed on the hook allows the griff bar to disengage from the hook and move upwardly while leaving the hook in its lower position.

The cord which extends between the respective hooks is of such a length that the individual springs, located above each of the eyelets, keeps the cord taut at all times. When both hooks are engaged by the respective griff bars, the hooks and cord travel in a seemingly see-saw like motion along with the griff bars. During this motion the cord is pulled back and forth through the pulley block and rollingly engages the sheave. Also during this pattern of motion, the pulley block and eyelet remain substantially stationary (in the upper position) being held in the same position by the tension of the spring.

In these weaving devices the lower end of each hook is engageable by means of a latch which is mounted on the frame and which is located near the bottom of the path of travel of each of the hooks. Each latch selectively captures and retains the respective hook in the lower position. If one of the hooks is held in its lower position by the respective latch, the associated griff bar disengages from the hook as it travels upwardly, leaving the hook retained by the latch in the lower position. As the griff bar moves upwardly, leaving the associated hook retained by the latch, the other hook (attached to the opposite end of the cord) is simultaneously pulled downwardly toward another latch by the other griff bar. Because the first hook is latched in the lower position, and is not allowed to travel upwardly while the other hook is being pulled downwardly, the pulley block is simultaneously pulled downwardly by the cord attached between the hooks. This action, of course, pulls the eyelet downwardly against the upwardly biasing force of the spring attached to same. This results in the eyelet reaching a lowermost position as both hooks reach their respective lowermost positions.

For the eyelet to remain in the lower position, both the first and second hooks must be retained in their respective lowermost positions by their respective latches. In this manner, the individual griff bars continue to reciprocally move in a see-saw like motion above both hooks, but do not cause movement of the hooks, cord, pulley block, or eyelet. Conversely, for the eyelet to move to its upper position once again, one of the latches must disengage from one of the hooks as the associated griff bar is located in the lowermost position. In this manner, one of the hooks is released by the latch and allowed to travel upwardly with the griff bar to its upper position under the influence of the spring. This action results in the respective pulley block and eyelet moving upwardly to the original upper position. For the eyelet to remain in the upper position, the other latch must also release its respective hook, allowing the see-saw like motion of the hooks and cord to resume as initially described.

Many Jacquard weaving devices utilize electric solenoids to effect the selective retention of the hooks by the latches. In this type of design, an electric solenoid is mounted on the frame near each of the respective latches. Mounted on each latch is a material which can be magnetically influenced, or attracted, such as iron, when the solenoid is energized with electrical current. Generally, each latch is biased into a first, or latched, position. During operation, as a hook is moved into engagement with the respective latch, the hook pushes the latch into a second, or unlatched position, and in the direction of the solenoid such that the magnetically attractable material is pressed against or moved closely adjacent to the solenoid. In the situation where the solenoid is energized, the material is strongly attracted to the solenoid by the magnetic field. This in turn holds the latch in the unlatched position which prevents the latch from capturing and retaining the hook in the lowermost position as the hook moves upwardly and away from the respective latch.

On the other hand, if the solenoid is not energized, the bias of the latch causes the latch to move back to the latched position as the hook begins to move upwardly. In this scenario, before the hook completely disengages from the latch, the latch captures the hook, thereby retaining it in the lowermost position. If the hook is retained by the latch, the griff bar will disengage from the hook and continue moving upwardly while leaving the hook in its lowermost position. However, the subsequent downward movement of the griff bar will again move the hook against the respective latch in a manner which will cause movement of the latch to the unlatched position. This enables the hook to be subsequently released from the latch if the latch had been held in the unlatched position by the solenoid. In this manner, the weaving device selectively moves the eyelet by energizing and de-energizing the solenoids at given intervals which controls the movement of the hooks. Often a controller, such as a programmable logic computer, is utilized to control electrical current flow to the solenoids and related motor which propels the individual griff bars.

Commonly, a Jacquard weaving device consists of at least one row of eyelets which are configured as discussed above, with respective springs, pulley blocks, cords, hooks, latches and solenoids for each eyelet. Usually, the entire row of eyelets is served by a single pair of elongated griff bars. In this manner, each individual eyelet in the row may be moved from either the upper position to the lower position, or vice versa, or may remain in either the upper or lower position with each reciprocal stroke of the griff bars. Often, large Jacquard weaving devices consist of several such rows of similarly configured eyelets, each with its own set of griff bars. Thus, by moving the griff bars at repeating intervals, and selectively controlling the energization of the solenoids, the controller can cause any combination of eyelets to either move up or down, or remain in the upper or lower positions, with each shed change.

While Jacquard weaving machines of conventional design have been operated with varying degrees of success, there have been recognized shortcomings which have detracted from their usefulness. For example, a relatively large Jacquard weaving machine may consist of a dozen or more rows of eyelets, each row having up to thirty or more eyelets. Such a machine, having hundreds of individually movable eyelets, will have a complex, tightly packed mechanism comprised of interactive, precision components, including griff bars and related drive trains, hooks, latches, solenoids, cords, guides, and pulley blocks. Thus, a malfunction or failure of a single component in this complex, tightly packed mechanism necessitates a tedious and time-consuming disassembly of the machine in order to simply gain access to the failed or malfunctioning part for removal and replacement. This tedious disassembly process of the machine results in costly down-time of the weaving device, during which the operation of the device is temporarily halted.

Therefore, it has long been known that it would be desirable to provide a Jacquard weaving machine which achieves the benefits to be derived from similar prior art devices, but which avoids the detriments individually associated therefrom.

OBJECTS AND SUMMARY OF THE INVENTION

In accordance with one aspect of the present invention the invention includes a solenoid unit for use with a weaving device having a frame; a plurality of eyelets mounted on the frame and individually moveable with respect to the frame; a support member releasably coupled to the frame; and a plurality of solenoids mounted on the support member, and wherein each solenoid controls the movement of at least one eyelet.

Another aspect of the present invention relates to a modular solenoid unit for use with a weaving device, the solenoid unit forming a removable component thereof, and which includes a frame; a plurality of eyelets movably mounted on the frame between a first position and a second position, and wherein during operation, the weaving device has a sequence of shed changes, and wherein during each shed change, a given eyelet either remains in the first position or is moved from the first position to the second position; a controller electrically coupled to the weaving device for controlling the nature of the shed change and the relative positions of the respective eyelets; a support member releasably coupled to the frame; and a plurality of solenoids mounted on the support member, and wherein the controller is electrically coupled to each of the solenoids, and wherein the given eyelets move between the first and second positions during a given shed change as a result of the controller energizing selected solenoids.

Yet another aspect of the present invention relates to a modular solenoid for use with a weaving device, the solenoid unit forming a removable component thereof, and which includes a frame; a plurality of eyelets mounted on the frame, and wherein each eyelet is individually moveable with respect to the frame between a first position and a second position, and wherein during operation, the weaving device proceeds through a predetermined sequence of shed changes, and wherein during each shed change, a given eyelet either remains in the first position or it is moved from the first position to the second position; a controller electrically coupled with the weaving device for controlling the nature of the shed change; a plurality of hooks mounted on the frame and individually coupled in forced transmitting relation relative to a given eyelet, and wherein the respective hooks are movable along a given path of travel; a griff bar movably mounted on the frame, and engageable with the respective hooks; a support member releasably coupled to the frame; and a plurality of solenoids mounted on the support member, and electrically coupled with the controller, and wherein the solenoids, when energized and de-energized, control the nature of the shed change.

Yet still another aspect of the present invention relates to a modular solenoid unit for use with a weaving device, the solenoid unit forming an easily detachable component thereof, and which includes a frame; a plurality of eyelets mounted on the frame, and wherein each eyelet is individually movable with respect to the frame between a first position and a second position, and wherein during operation, the weaving device proceeds through a sequence of shed changes, and wherein during a given shed change a given eyelet either remains in the first position or is moved from the first position to the second position; a controller coupled to the frame and controlling the nature of the shed change; a plurality of hooks, which are individually mounted on each eyelet; a plurality of latches mounted on the frame, and movable along a given path of travel relative thereto to selectively coact with individual hooks; a griff bar movably mounted on the frame, and selectively coacting with the individual hooks; a support member releasably coupled to the frame; and a plurality of solenoids mounted in a given pattern on the support member, and wherein the controller is electrically coupled to each of the solenoids, and wherein the energizing and the de-energizing of the respective solenoids cause the latches to be located at predetermined locations along the path of travel to coact with the hooks and griff bar.

Yet still a further aspect of the present invention relates to a modular solenoid unit for use with a weaving device, the solenoid unit forming an easily detachable component thereof and which includes a frame defining an elongated channel, and wherein the frame has two sidewalls and a base member which are coupled together, and wherein the base member defines an opening having two elongated edges, and wherein the edges are substantially parallel to each other, and wherein the opening has a substantially constant width; a plurality of eyelets mounted on the frame, and wherein each eyelet is individually movable with respect to the frame between a first position and a second position, and wherein during operation, the weaving device proceeds through a sequence of shed changes, and wherein during a given shed change, a given eyelet either remains in the first position or is moved from the first position to the second position; a controller electrically coupled to the frame and controlling the nature of the shed changes; a plurality of hooks which are individually mounted on each eyelet; a plurality of latches mounted on the frame, and wherein each latch is movable relative to the frame between a first position and a second position to coact with the respective hooks under the influence of electromagnetic energy; a griff bar movably borne by the frame, and coacting with the individual hooks; an elongated support member slidably interlocking with the channel which is defined by the frame, and wherein the channel releasably retains the support member in an operable orientation relative to the latches; and a plurality of solenoids mounted in a given pattern on the support member, and wherein the controller is electrically coupled to each of the solenoids, and wherein an electro-magnetic field of energy is produced by a given solenoid as a result of the controller energizing the given solenoid by allowing electrical current to flow through the given solenoid, and wherein energizing the given solenoids causes the given solenoid to remain in the second position, and wherein de-energizing the solenoid causes the given solenoid to move from the second position to the first position, and wherein the position of the given latch effects the manner in which the given solenoid coacts with a given hook, and the nature of the resulting shed change.

BRIEF DESCRIPTION OF THE DRAWINGS

Preferred embodiments of the invention are described below with reference to the following accompanying drawings.

FIG. 6 is a fragmentary perspective view of the solenoid unit of the subject apparatus.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
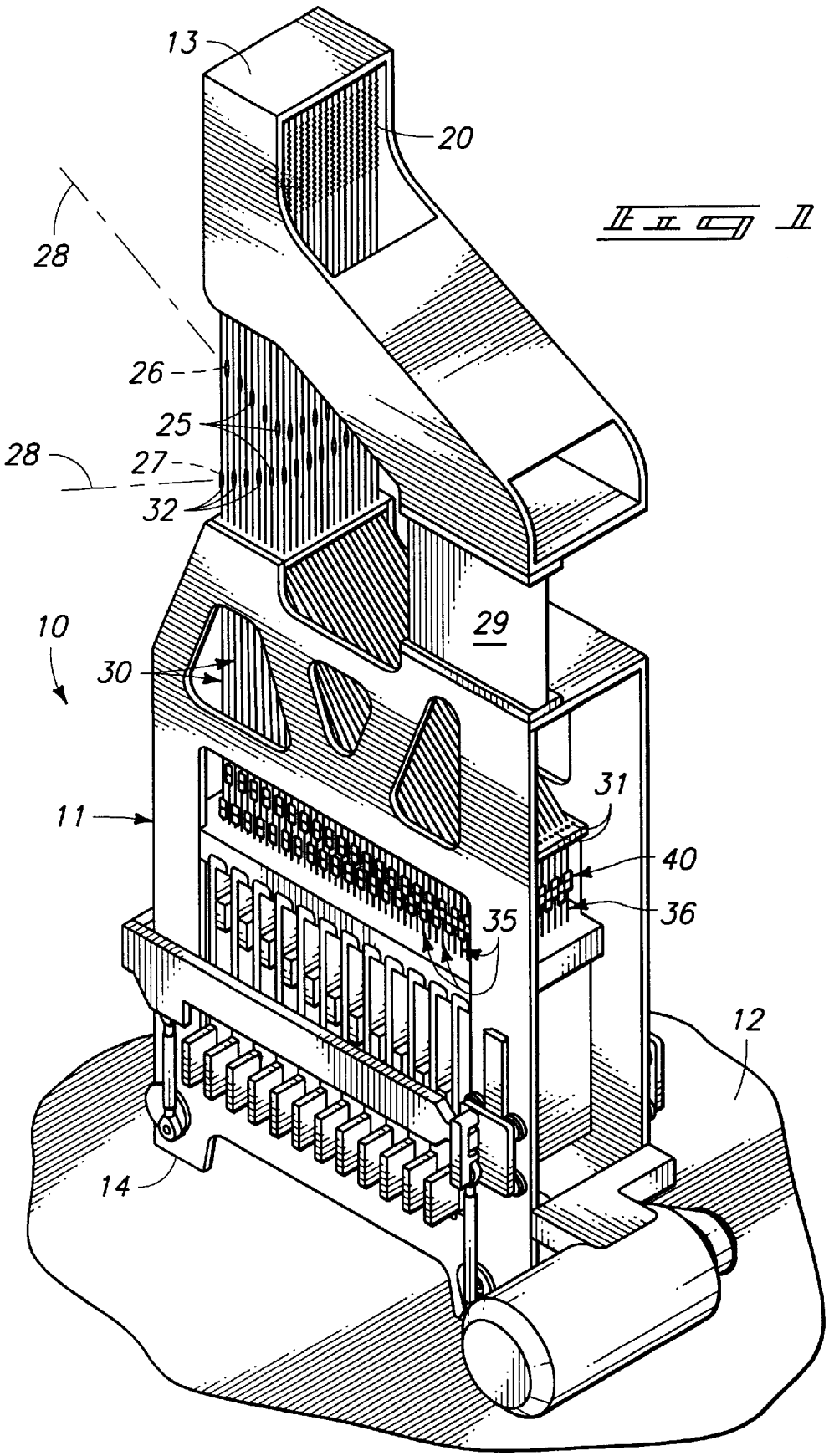
FIG. 1 is a partial, vertical, sectional view of the subject invention.
Figure 2:
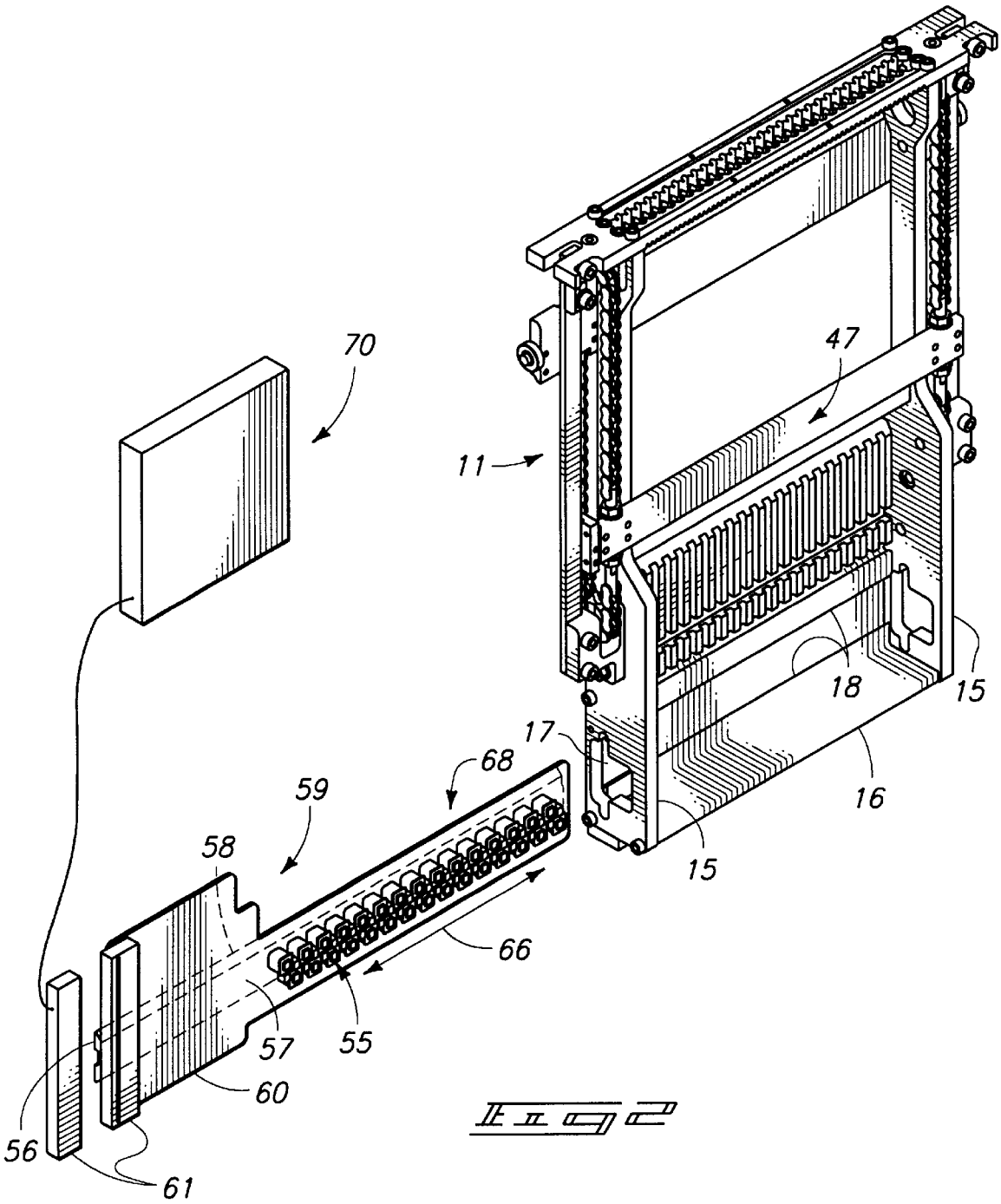
FIG. 2 is a partial, exploded, perspective view showing the frame of the subject invention and an associated solenoid unit.
Figure 4:
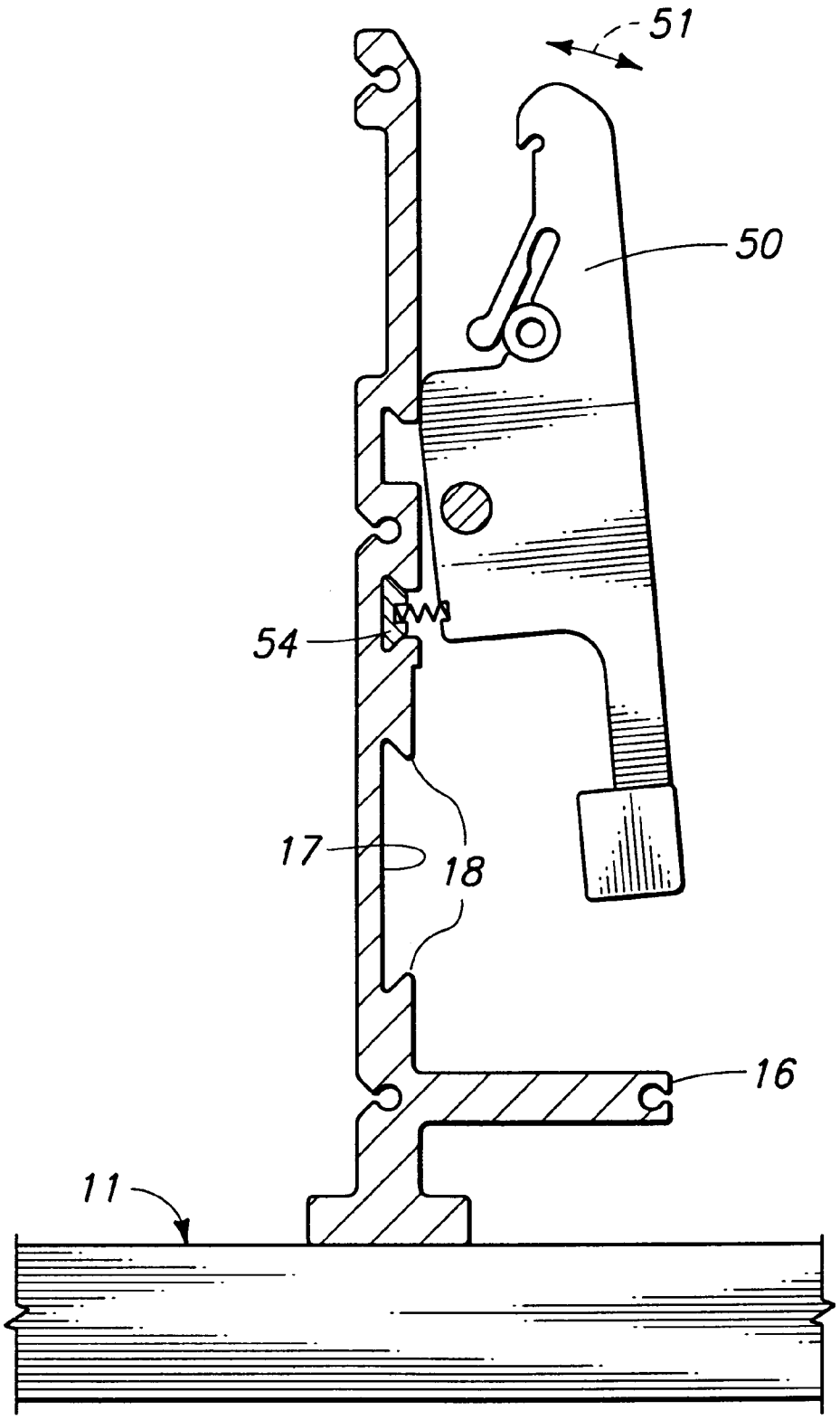
FIG. 4 is a fragmentary side elevation view of a base member and latch showing the channel for mounting the solenoid unit, and which is taken from a position along line 4—4 of FIG. 3.
Figure 5:
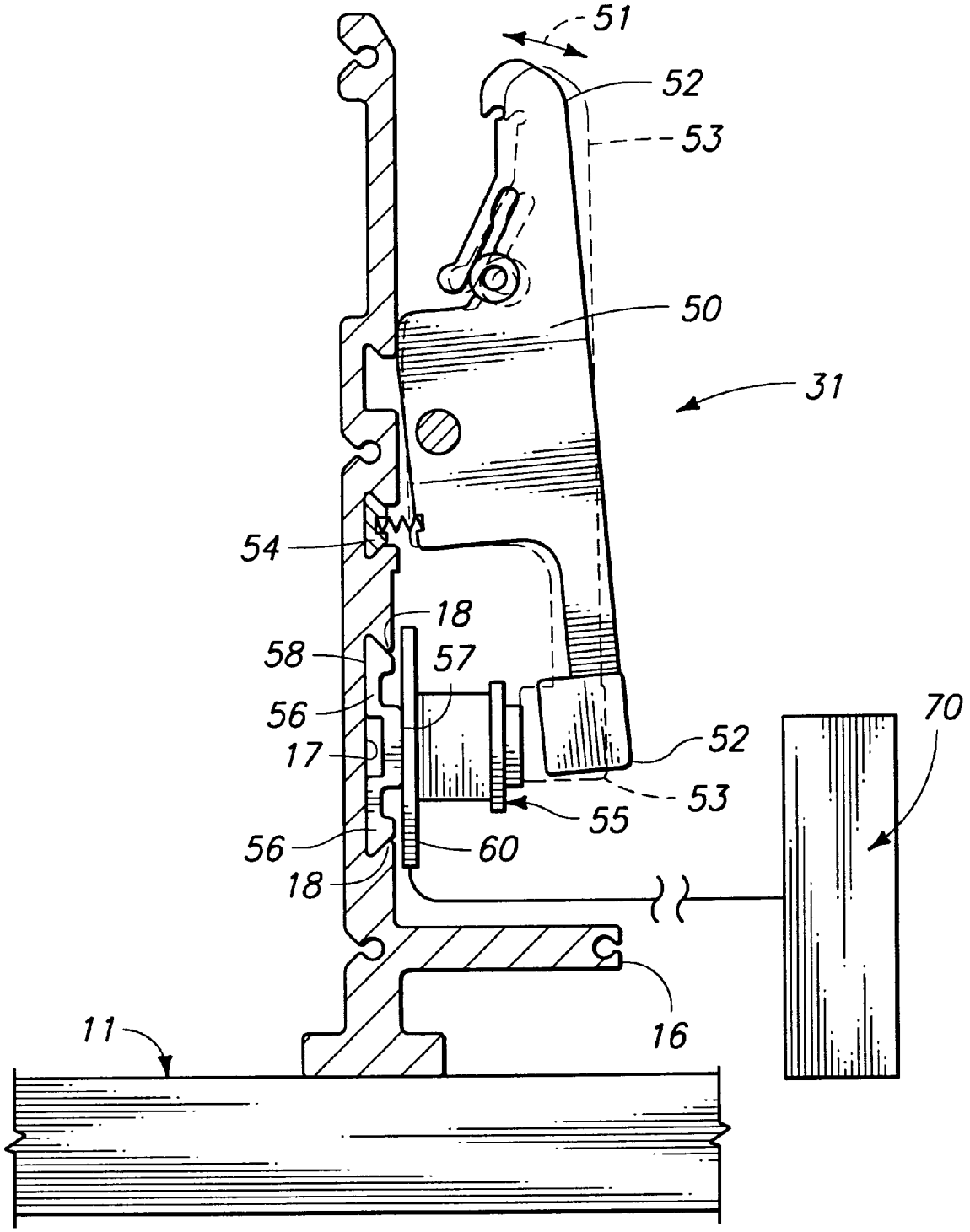
FIG. 5 is a second fragmentary side elevation view of the base member and latch showing the positions of the latch with the solenoid unit installed.

The apparatus of the subject invention is best understood by a study of FIG. 1 and is generally indicated by the numeral 10. As shown in FIG. 1, the apparatus 10 includes a frame 11 which rests on the surface of the earth 12. The frame 11 has an upper portion or end 13 and a lower portion or end 14. Referring to FIG. 2, module portions of the frame 11 each include two sidewalls 15 and a base member 16 which are coupled together. The frame 11 also defines an elongated substantially rectangular shaped channel 17 which is defined by the base member 16 as shown in FIGS. 2, 4. The channel 17 is defined by two elongated edges 18 which are substantially parallel to each other. As can also be seen in FIGS. 2, 4, the channel 17 has a substantially constant width. As is evident from a study of FIGS. 2 and 4, the channel 17 is substantially in the form of a dove-tail groove.

As further shown in FIG. 1, the apparatus 10 also includes a plurality of resilient members 20 mounted on the upper end 13 of the frame 11, and a plurality of eyelets 25 which are individually movably mounted on the frame 11 by way of the respective resilient members 20. Each eyelet 25 is individually movable with respect to the frame 11 between an upper first position indicated by the numeral 26 and dashed lead, and a lower second position indicated by the numeral 27 and dashed lead line. The resilient members 20 bias the eyelets 25 toward the respective upper positions 26. The eyelets 25 form a triangular or wedge shaped shed 28 as may be understood from FIG. 1.

The eyelets 25 are each intended to slidably receive a warp thread (not shown). Together, the warp threads extending through the eyelets 25 form the shed 28 which may be altered by changing positions of selected eyelets between the upper first and lower second positions 26, 27. The warp threads pass through a harness section of the weaving device frame 11 to the eyelets. A preferred frame 11 as shown in FIG. 1 includes a single pedestal harness 29 adjacent the eyelets, forming the harness area in a laterally open "C" shaped configuration. This configuration facilitates threading of the eyelets 25 without requiring that the warp threads first be threaded through a closed harness, as in prior weaving machines.

Figure 3:
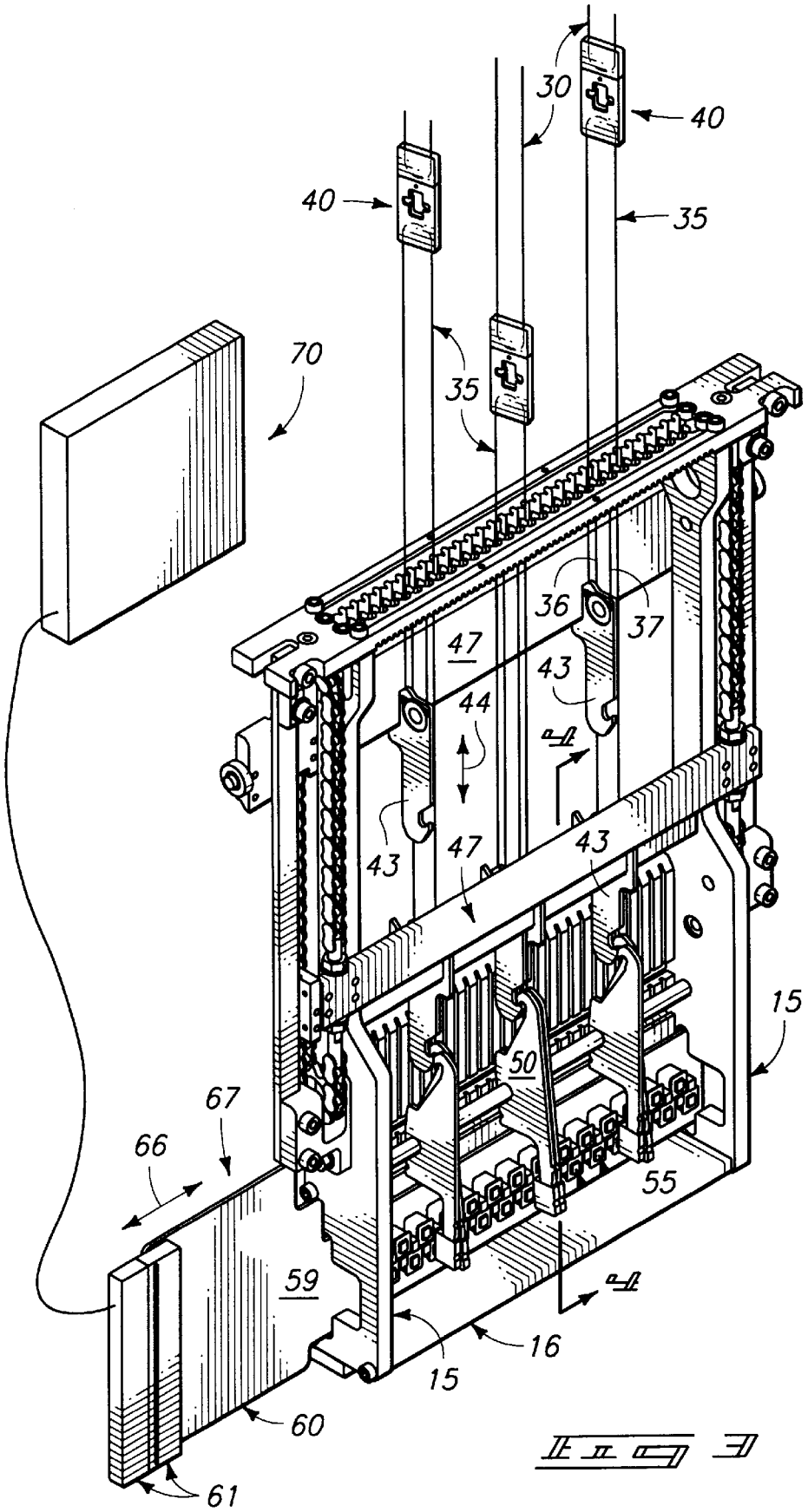
FIG. 3 is a partial, perspective view showing the frame of the subject invention with the solenoid unit installed.

A further study of FIG. 1 will illustrate that the apparatus 10 also includes first cords 30 each of which has a first end 31 mounted on the frame 11, and a second end 32 affixed on the eyelet 25. The apparatus 10 also includes second cords 35, each having a first end 36, and a second end 37 (FIG. 3). Pulley blocks 40 are operably disposed intermediate the first and second cords as shown in FIGS. 1 and 3. Both ends 36, 37 of the second cords 35 extend downwardly from the associated pulley block 40.

As further shown in FIG. 3, a plurality of hooks 43 are mounted on the frame 11, and are selectively coupled in force transmitting relation relative to a given eyelet by way of the first and second cords 30 and 35 and pulley blocks 40. As may be seen in FIG. 2, a pair of hooks 43 are mounted to one of the second cords 35, such that a pair of hooks 43 are individually connected to each eyelet 25. Furthermore, each of the respective hooks 43 is reciprocally movable along a given path of travel indicated by the line labeled 44 as seen in FIG. 3. As further shown in FIGS. 2 and 3, griff bars 47, are movably mounted on the frame 11 to engage with the respective hooks 43. Each griff bar 47 is one of a pair of griff bars 47 which are movably borne by the frame 11, and which coact with respective pairs of hooks 43. The griff bars also move generally along the path of travel 44 of the hooks 43 as indicated in FIG. 3.

Further study of FIGS. 3 and 4 will show that the apparatus 10 includes a plurality of latches 50 which are mounted on the frame 11, and which are movable along a given path of travel 51 to selectively coact with the hooks 43. Each latch 50 includes a surface which is attractable by electromagnetic energy. As shown in FIG. 4, each latch 50 is movable along the path of travel 51 relative to the frame 11 between a first, or latched, position 52 and a second, or unlatched, position 53. The latches 50 are movable between the first 52 and second 53 positions to coact with the hooks 43 under the influence of the hooks and by electromagnetic energy. Each latch 50 is biased in the first, or latched, position by a biasing member 54 which may be comprised of a coiled compression spring.

As best seen in FIGS. 2 and particularly in FIG. 6, the apparatus 10 further includes a plurality of solenoids 55 mounted on support members 56. Each support member 56 has a first side indicated by the numeral 57 and an opposite second side indicated by the numeral 58. The support member has a complimentary dove-tailed shape which allows it to be matingly received in the channel 17. As best seen in FIG. 6, the solenoids 55 are mounted on the first side 57 of the support member 56. The second side 58 of the support member 56 is disposed in juxtaposed relation (FIG. 3) relative to the base member 16 of the frame 11 when slidably received in the channel. This is seen most clearly in FIGS. 5 and 7–11. The individual solenoids 55 together with the associated support member 56 form an easily removable solenoid unit one of which is generally indicated by the numeral 59 (FIG. 6).

Still referring to FIGS. 2 and 6, the apparatus further includes circuit boards 60 mounted between associated solenoids 55 and support members 56. The circuit boards 60 are electrically connected to each set of solenoids 55 by way of electrical tracings (not shown). Further included in the apparatus 10 are releasable electrical couplings 61 which are disposed in current conducting relation relative to the associated solenoids 55 by way of the circuit boards 60. The coupling 61 can be easily released from the circuit boards 60.

As best seen in FIG. 6, the solenoids 55 on each circuit board are arranged in a given pattern of at least two parallel, laterally offset rows. The first row of solenoids 55 is indicated generally by the numeral 63, while the second row of solenoids is generally indicated by the numeral 64. As further shown in FIG. 6, the solenoids 55 in each row 63 and 64, are substantially equally spaced, one from another, and a given row 63 is offset from an adjacent row 64 such that a given solenoid 55 in one row 63 is located substantially midway between two adjacent solenoids 55 of the adjacent row 64.

Referring now to FIGS. 2, 4, 5, and 6, each solenoid unit 59 is releasably coupled to the frame 11 by way of a support member 56 which slidably and matingly engages the frame 11. As earlier discussed, the channels 17 matingly receive the support members 56 therein. As shown in FIG. 2 and 3, the illustrated support member 56 slidably engages the frame 11 as the solenoid unit 59 is appropriately oriented relative to the frame 11. The support member 56 is slidably movable along a predetermined path of travel indicated by the line labeled 66 between a first operational position 67 (FIG. 3), and a disengaged position 68 (FIG. 2).

As shown in FIGS. 1 through 6, and as discussed above, the complementary shapes of the associated support members 56 and channels 17 allow the support members 56 to slidably interlock with the channels 17 which are formed in the base members 16, such that the channels 17 releasably retain the support members 56 in operable orientations with the latches 50. As previously mentioned, each channel 17 may be described as a dove-tail groove due to its cross-sectional shape, although other cross-sectional shapes may be used with equal success. At least two support members 56 are detachably mounted on the frame 11 in the manner described.

Also as best seen in FIG. 3, each solenoid 55 coacts with two given latches 50 when the associated support member 56 is mounted in the channel 17. As further shown by reference to FIG. 2 and 3, the latches 50 are mounted in pairs. A given pair of latches 50 is positioned in operable relation to a given solenoid 55 such that the given solenoid 55 coacts with both latches 50 to effect the movement of an associated eyelet 25. In other words, as best seen by reference to FIG. 3, each of a given pair of latches 50 coact, respectively, with each of a given pair of hooks 43 which are mounted on a given second cord 35. Referring now to FIG. 1, each second cord 35 is connected to a given eyelet 25 by way of the respective pulley block 40 and first cord 30.

Referring once again to FIG. 3, each pair of latches 50 are mounted in operable relation relative to a given solenoid 55 so that one of the given pair of latches 50 contacts substantially half of the solenoid 55 while the other latch 50 contacts substantially the remaining half of the given solenoid 55. Thus, each latch 50 of a given pair coacts with a respective half of a given solenoid 55. In this manner, a given solenoid 55 coacts with both latches 50 of a pair to effect the movement of the associated eyelet 25.

Figure 7:
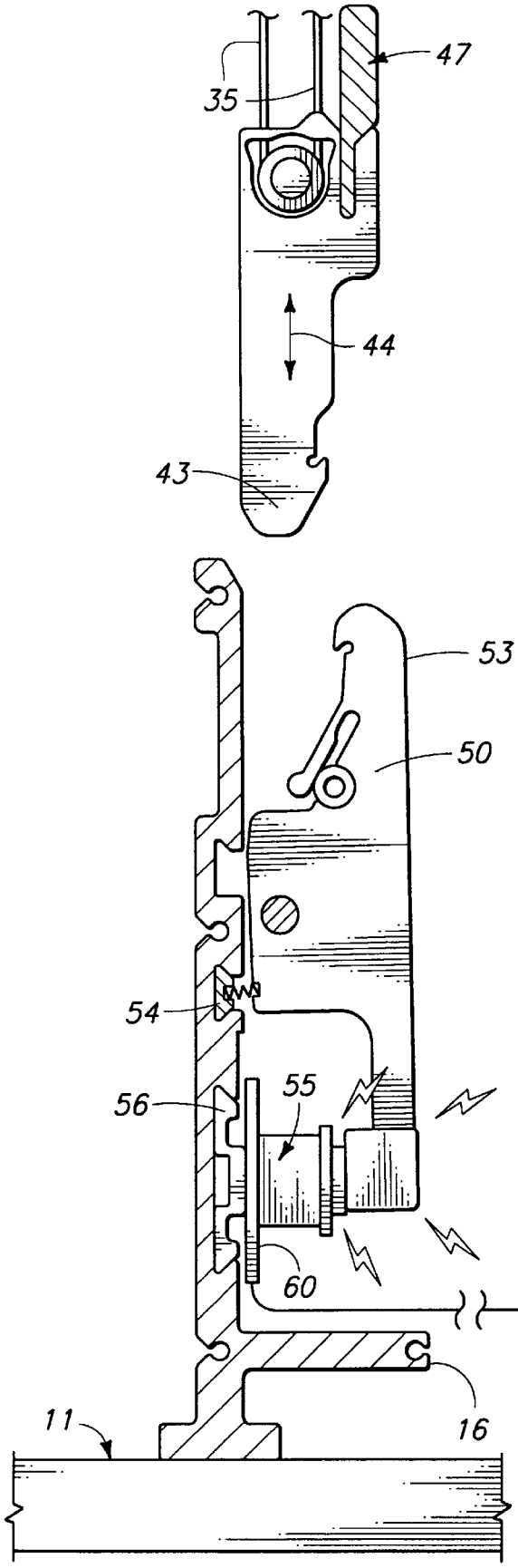
FIG. 7 is a fragmentary side elevation view of the base member, latch and hook similar to FIG. 4 only showing the latch held in the latched position and the hook disengaged from the latch.

As further shown in FIG. 2, the solenoid unit 59 is electrically coupled to a controller 70. The controller may be a programmable logic computer of various types. The controller 70 is electrically coupled to each of the solenoids 55. The releasable electrical coupling 61 allows the solenoid unit 59 to be easily uncoupled or disconnected from the controller 70. It is feasible that the coupling 61 be integrated with the controller 70 to eliminate the need for ribbon electrical wire connectors if desired. Each solenoid 55 produces a magnetic field when energized as seen in FIG. 7 with electrical current supplied by the controller 70.

OPERATION

The operation of the described embodiment of the present invention is believed to be readily apparent and is briefly summarized at this point. As seen in FIG. 1, and during operation, the weaving device apparatus 10 proceeds through a predetermined sequence of shed changes by moving selected eyelets 25 between the upper 26 and lower 27 positions. During each shed change, a given eyelet 25 either remains in the first, or upper, position 26, or is moved from the first position 26 to the second, or lower, position 27 or vice versa to form a new shed 28. Each shed change is accomplished by coactive operation of the griff bars 47, hooks, 43, latches 50, solenoids 55, and controller 70.

Figure 8:
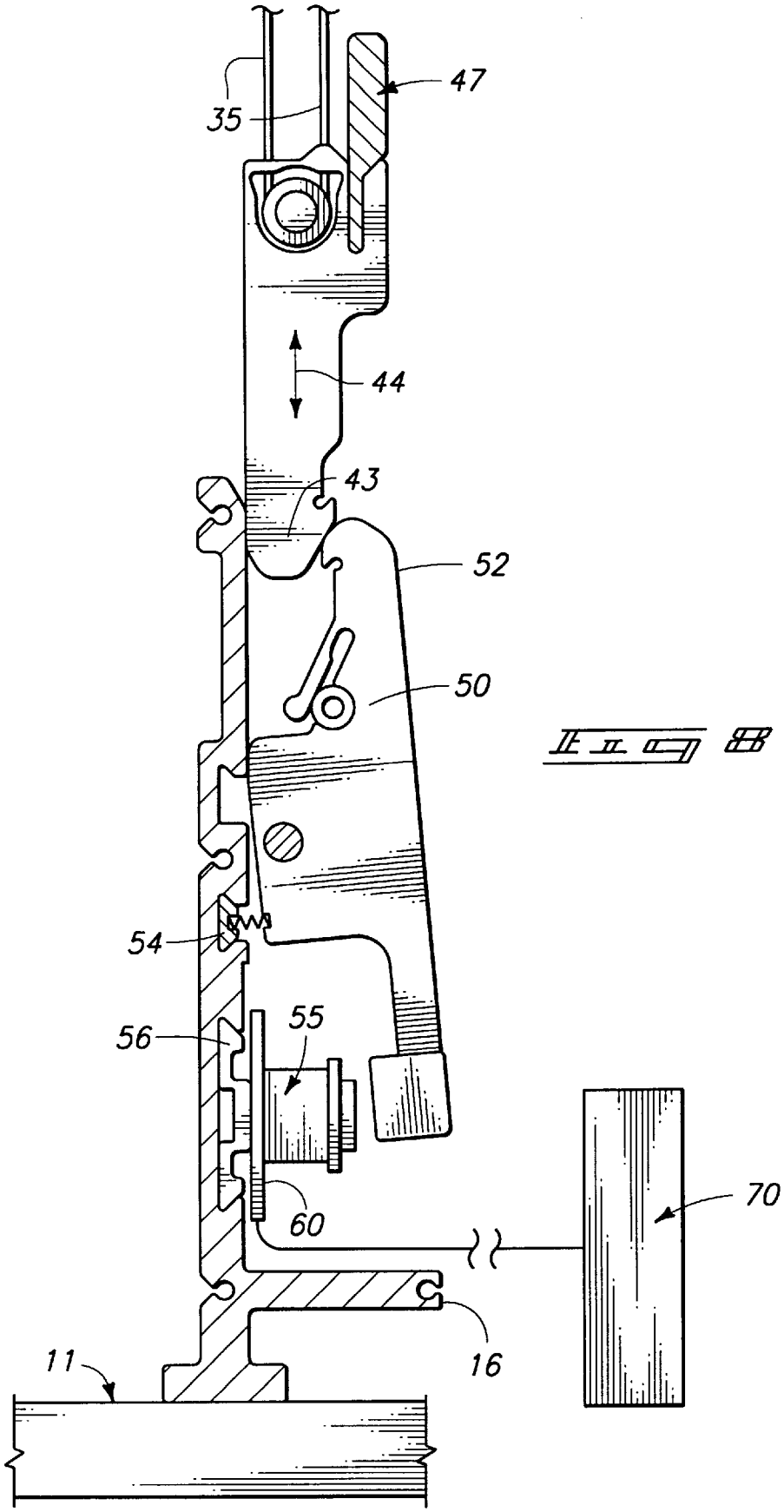
FIG. 8 is a fragmentary side elevation view of the base member, latch and hook similar to FIG. 4 only showing the hook engaging the latch.

As earlier discussed, the griff bars 47 move relative to the frame 11 and substantially along the path of travel 44 of the hooks 43. During this movement, the griff bars 47 engage the hooks 43 and move same along the path of travel 44. Referring to now FIG. 10, the griff bars 47 move at least some of the hooks 43 downwardly toward the latch 50 along the path of travel 44. As further shown by reference to FIG. 5, the latches 50 are biased along the path of travel 51 into the first, or latched, position 52 by the biasing member 54. Referring now to FIG. 8, as the griff bars 47 move hooks 43 into contact with the associated latches 50, and the griff bars 47 continue to move downwardly along the path of travel 51, the latches are moved along the path of travel 51 in the direction of the unlatched position 53.

Figure 9:
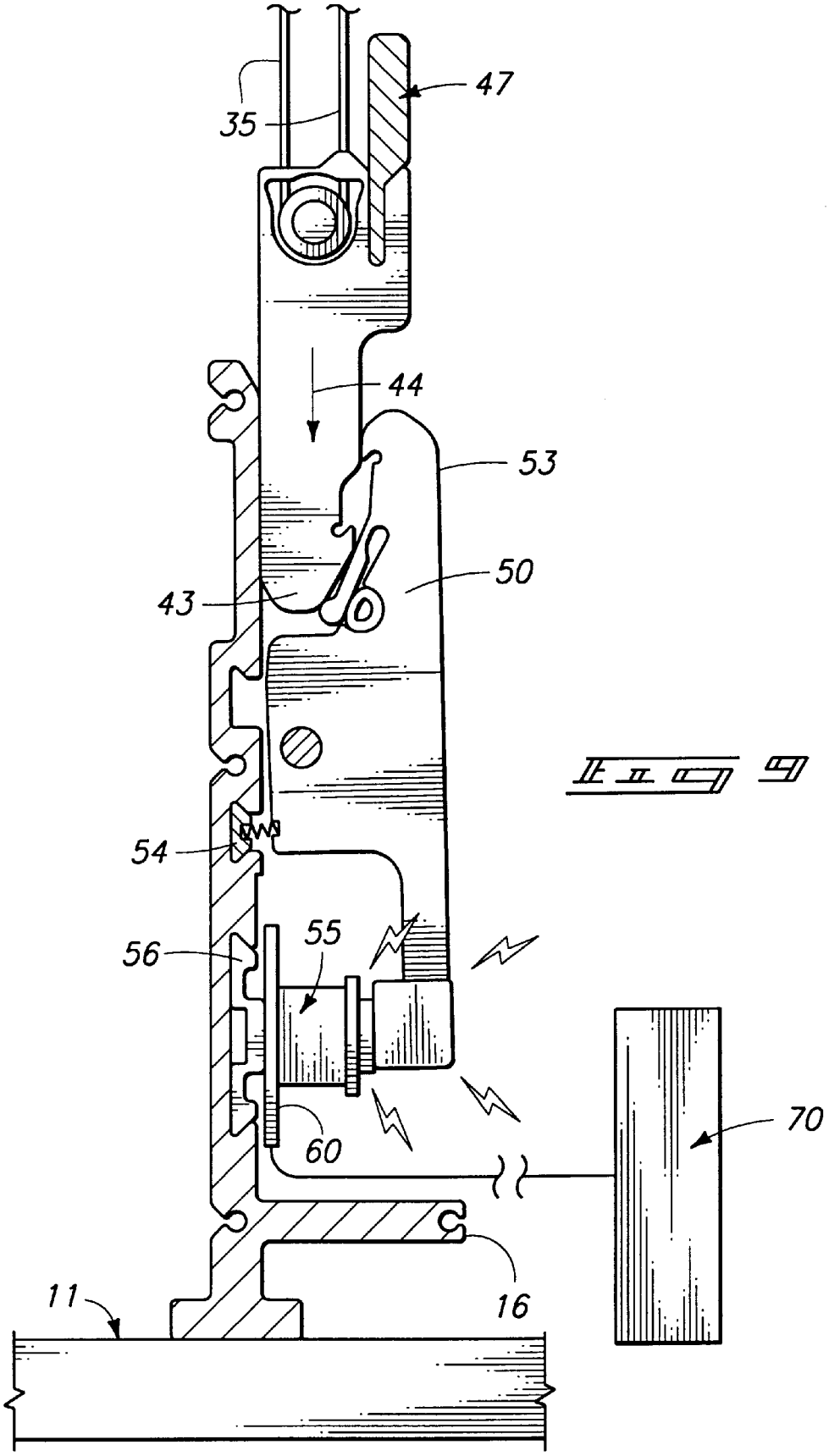
FIG. 9 is a fragmentary side elevation view of the base member, latch and hook similar to FIG. 4 only showing the hook moving the latch to the latched position, and which is taken from a position along line 4—4 of FIG. 3.
Figure 10:
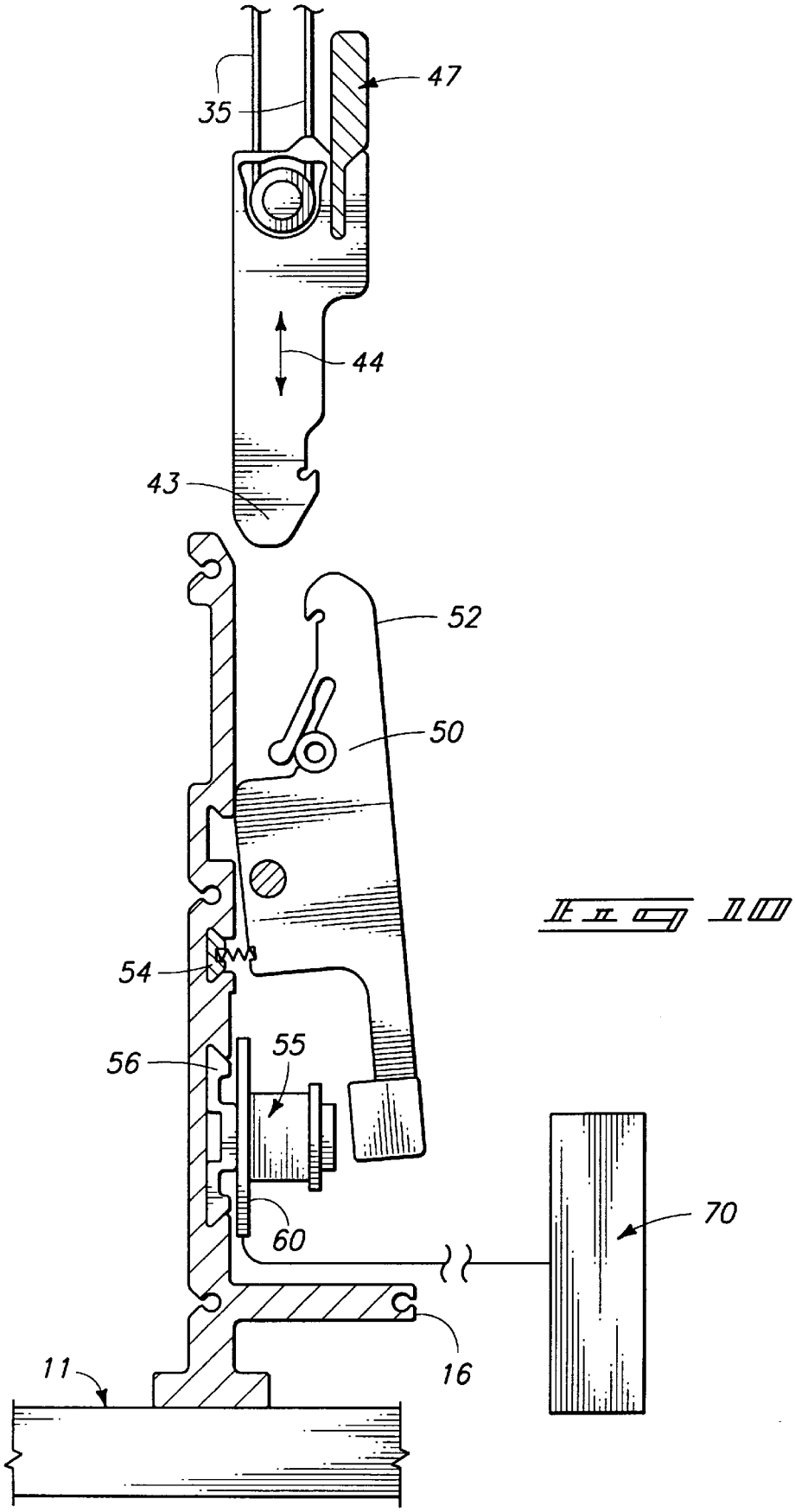
FIG. 10 is a fragmentary side elevation view of the base member, latch and hook similar to FIG. 4 only showing the hook approaching the latch.
Figure 11:
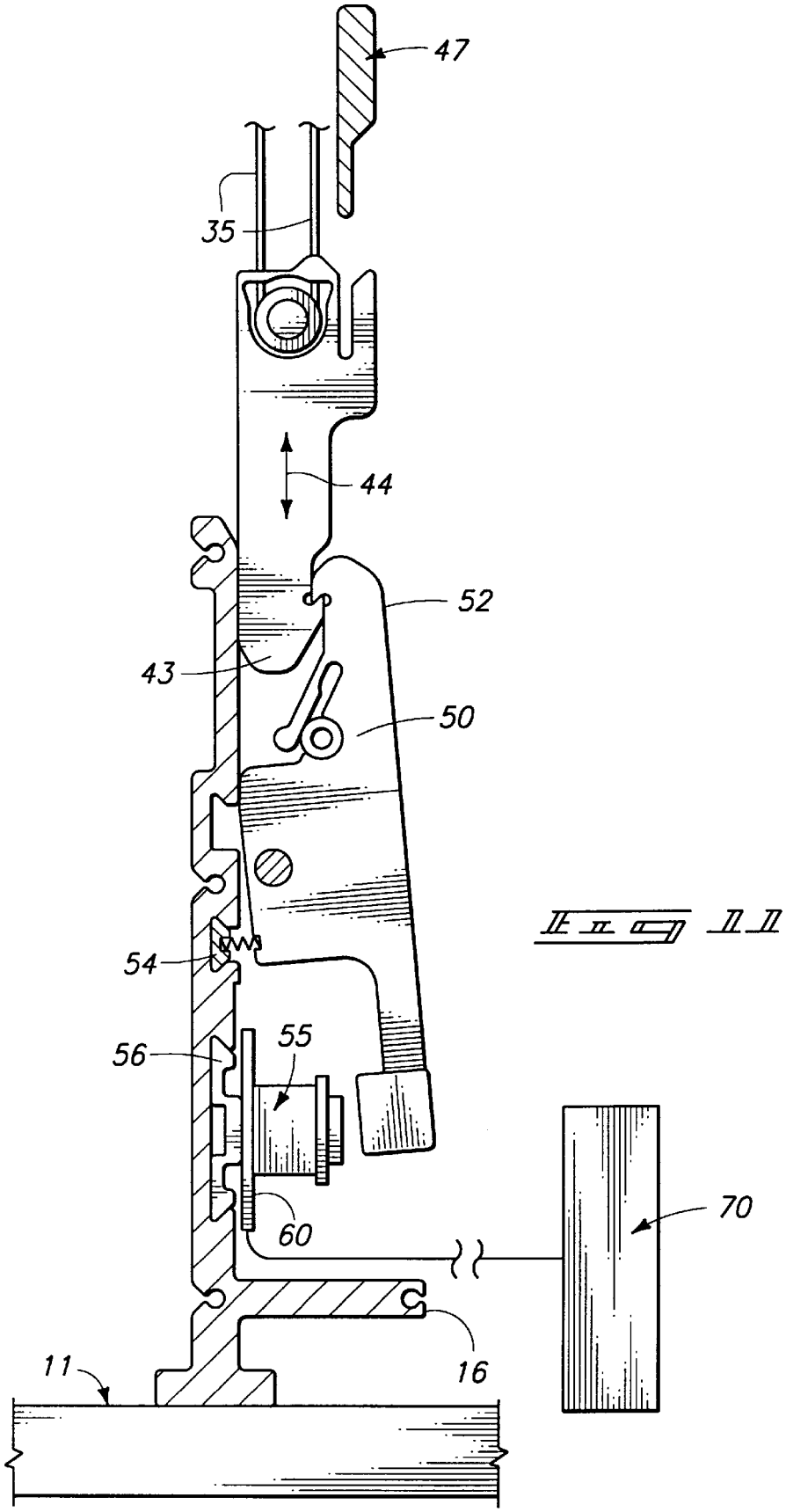

As shown now in FIG. 9, continued movement of the hooks 43 against the latches 50 causes the engaged latches 50 to move from the first, or latched, positions 52 to the second, or unlatched, positions 53. When in the second, or unlatched, positions 53, the latches 50 come into contact, or close proximity, with the solenoids 55 as shown in FIG. 9.

Referring now to FIG. 7, if the controllers 70 energize selected solenoids 55 with electrical current when the associated latches 50 are in the second, or unlatched, positions 53, under those conditions the latches 50 will be retained by the solenoids 55 in the unlatched position 53 by the electromagnetic fields. When this occurs, the hooks 50 will disengage the respective latches 50 and move upwardly along the path of travel 44 with the griff bars 47.

Figure 11:
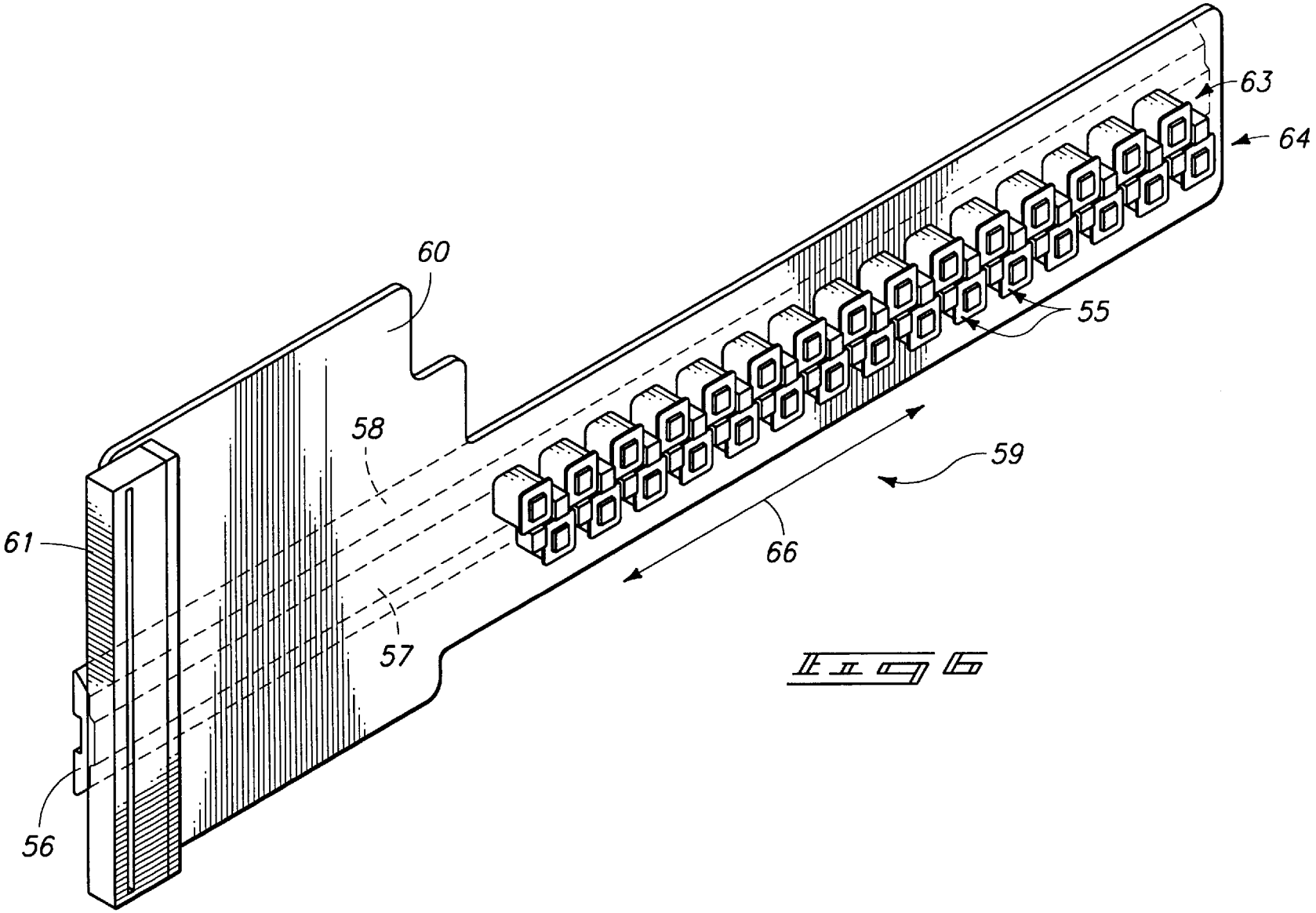
FIG. 11 is a fragmentary side elevation view of the base member, latch and hook as the latch captures and retains the hook and the griff bar disengages from the hook.

Alternatively, if the controllers 70 do not energize selected solenoids 55 while the solenoids 55 are in the unlatched positions 53, then the latches 50 will return to the latched position 52 due to the biasing action of the biasing members 54 as the hooks 43 begin to move upwardly. This is best seen in FIG. 11. In this situation, latches 50 will capture and retain the associated hooks 43 as the griff bars 47 disengage the hooks 43 and continue to move upwardly.

As now seen, energizing a given solenoid 55 causes a given latch 50 to remain in the second position 53, and de-energizing the solenoid 55 causes the given latch 50 to move from the second position 53 to the first position 52 to therefore engage one of the hooks 43. This illustrates the manner in which the energizing and de-energizing of the respective solenoids 55 causes the latches 50 to be located at predetermined locations along the path of travel 44 to coact with the respective hooks 43 and griff bars 47.

Referring now to FIG. 1, it can be seen that if both hooks 43 (of a pair) which act on a given eyelet 25, are retained by the respective latches 50, the eyelet 25 will be retained in the lower position 27. Thus, it can be seen that the position of the given latch 50 effects the manner in which the given latch 50 coacts with a given hook 43, and the nature of the resulting shed change. As discussed earlier, the given eyelet 25 moves between the first, or upper, position 26 and the second, or lower, position 27 during a given shed change as a result of the associated controller 70 energizing a selected solenoid 55. In this arrangement each solenoid 55 facilitates movement of at least one eyelet 25 from the first position 26 to the second position 27. Therefore, the controllers 70, by energizing and de-energizing selected solenoids 55, control the nature of each shed change.

Should a solenoid 55 malfunction, causing a halt in the operation of the apparatus 10, the controller 70 can be readily uncoupled from the solenoids 55. The solenoid unit 59, comprising solenoids 55 and associated support member 56 then may be slidably detached from the channel 17 formed in the frame 11 by moving the support member 54 from the first, or operational, position 67 to the second, or disengaged, position 68 along the path of travel 66.

Upon detachment of the malfunctioning solenoid unit 59, an identical, replacement solenoid unit 59 is slidably installed in the channel 17 along the path of travel 66 to the operational position 67 and coupled to the controller 70 using the coupling 61. Thus, the solenoid unit 59 forms a removable and easily detachable component of the weaving device apparatus 10 which facilitates removal and replacement of malfunctioning solenoids 55.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A solenoid unit for use with a weaving device comprising:

a frame;

a plurality of eyelets mounted on the frame and individually movable with respect to the frame;

a support member releasably coupled to the frame; and a plurality of solenoids mounted on the support member, and wherein each solenoid controls the movement of at least one eyelet.

2. A solenoid unit as claimed in claim 1, and wherein the frame includes a single pedestal harness adjacent to the plurality of eyelets.

3. A solenoid unit as claimed in claim 2, and wherein the support member slidably engages the frame.

4. A solenoid unit as claimed in claim 3, and wherein the support member has a given shape, and wherein the frame has a complementary channel formed therein which matingly receives the support member.

5. A solenoid unit as claimed in claim 4, and wherein the support member has a first side and an opposite second side, and wherein the solenoids are mounted on the first side.

6. A solenoid unit as claimed in claim 5, and wherein the respective solenoids are arranged in at least two substantially parallel rows, and wherein the individual solenoids in each row are substantially equally spaced, one from another, and wherein each row of solenoids is offset from an adjacent row of solenoids such that a given solenoid in one row is substantially midway between two adjacent solenoids of the adjacent row.

7. A solenoid unit as claimed in claim 6, and wherein each solenoid produces a magnetic field when energized with electrical current.

8. A solenoid unit as claimed in claim 7, and wherein the solenoid unit is electrically coupled to a controller, and wherein the controller selectively supplies electrical current to each of the individual solenoids.

9. A solenoid unit as claimed in claim 8, and further comprising a releasable electrical coupling which allows the solenoid unit to be uncoupled from the controller.

10. A solenoid unit as claimed in claim 9, and wherein at least two support members are detachably mounted on the frame.

11. A modular solenoid unit for use with a weaving device, the solenoid unit forming a removable component thereof, comprising:

a frame;

a plurality of eyelets movably mounted on the frame between a first position and a second position, and wherein during operation, the weaving device proceeds through a sequence of shed changes, and wherein during each shed change, a given eyelet either remains in the first position or is moved from the first position to the second position;

a controller electrically coupled to the weaving device for controlling the nature of the shed change and the positions of the respective eyelets;

a support member releasably coupled to the frame; and a plurality of solenoids mounted on the support member, and wherein the controller is electrically coupled to each of the solenoids and wherein the given eyelet moves between the first and second positions during a given shed change as a result of the controller energizing selected solenoids.

12. A solenoid unit as claimed in claim 11, and wherein the support member slidably engages the frame.

13. A solenoid unit as claimed in claim 12, and wherein the support member matingly couples with the frame, and is slidably moveable along a predetermined path of travel between a first operational position, and a second disengaged position.

14. A solenoid unit as claimed in claim 13, and wherein the support member has a first side and an opposite second side, and wherein the solenoids are mounted on the first side, and wherein the second side is disposed in juxtaposed relation relative to the frame.

15. A solenoid unit as claimed in claim 14, and wherein the respective solenoids are arranged in at least two substantially parallel rows, and wherein each of the solenoids in each of the rows are substantially equally spaced, one from another, and wherein a given row of solenoids is laterally offset from an adjacent row of solenoids.

16. A solenoid unit as claimed in claim 15, and wherein each of the solenoids produces a magnetic field when energized.

17. A solenoid unit as claimed in claim 16, and further comprising a releasable electrical coupling which allows the solenoid unit to be uncoupled from the controller.

18. A solenoid unit as claimed in claim 17, and wherein at least two support members are releasably coupled to the frame, and wherein a plurality of solenoids are mounted on each support member.

19. A modular solenoid unit for use with a weaving device, the solenoid unit forming a removable component thereof, comprising:

a frame;

a plurality of eyelets mounted on the frame, and wherein each eyelet is individually movable with respect to the frame between a first position and a second position, and wherein during operation, the weaving device proceeds through a predetermined sequence of shed changes, and wherein during each shed change, a given eyelet either remains in the first position or is moved from the first position to the second position;

a controller electrically coupled with the weaving device for controlling the nature of the shed change;

a plurality of hooks mounted on the frame and individually coupled in force transmitting relation relative to a given eyelet, and wherein the respective hooks are moveable along a given path of travel;

a griff bar movably mounted on the frame, and engageable with the respective hooks;

a support member releasably coupled to the frame; and a plurality of solenoids mounted on the support member, and electrically coupled with the controller, and wherein the solenoids, when energized and de-energized, control the nature of the shed change.

20. A solenoid unit as claimed in claim 19, and wherein the support member slidably engages the frame.

21. A solenoid unit as claimed in claim 20, and wherein the frame has an elongated, substantially linear channel formed therein, and wherein the support member slidably interlocks with the channel.

22. A solenoid unit as claimed in claim 21, and wherein the solenoids are arranged in a given pattern, and wherein the weaving device further comprises a plurality of latches which coact with the solenoids to further control the nature of the shed change.

23. A solenoid unit as claimed in claim 22, and wherein the solenoids are arranged in at least two parallel rows, and wherein the solenoids in each row are substantially equally spaced, one from another, and wherein a given row is laterally offset from an adjacent row of solenoids.

24. A solenoid unit as claimed in claim 23, further comprising an electrical coupling mounted in current conducting relation between the solenoids and the controller, and which allows the solenoid unit to be easily disconnected from the controller.

25. A solenoid unit as claimed in claim 24, and wherein the support member has a first side and an opposite second side, and wherein the solenoids are mounted on the first side, and wherein the second side is disposed in juxtaposed relation relative to the frame.

26. A solenoid unit as claimed in claim 24, and wherein at least two support members are releasably coupled to the frame, and wherein a plurality of solenoids are mounted on each support member.

27. A modular solenoid unit for use with a weaving device, the solenoid unit forming an easily detachable component thereof, comprising:

a frame;

a plurality of eyelets mounted on the frame, and wherein each eyelet is individually movable with respect to the frame between a first position and a second position, and wherein during operation, the weaving device proceeds through a sequence of shed changes, and wherein during a given shed change, a given eyelet either remains in the first position or is moved from the first position to the second position;

a controller coupled to the frame and controlling the nature of the shed change;

a plurality of hooks, which are individually mounted on each eyelet;

a plurality of latches mounted on the frame, and moveable along a given path of travel relative thereto to selectively coact with hooks;

a griff bar movably mounted on the frame, and selectively coacting with the individual hooks;

a support member releasably coupled to the frame; and a plurality of solenoids mounted in a given pattern on the support member, and wherein the controller is electrically coupled to each of the solenoids, and wherein the energizing and de-energizing of the respective solenoids causes the latches to be located at predetermined locations along the path of travel to coact with the hooks and griff bar.

28. A solenoid unit as claimed in claim 27, and wherein the support member slidably detaches from the frame.

29. A solenoid unit as claimed in claim 28, and wherein the frame has an elongated, substantially linear channel formed therein and wherein the support member slidably interlocks with the channel.

30. A solenoid unit as claimed in claim 29, and wherein the solenoids are arranged in a given pattern, and wherein the latches coact with the solenoids to further control the nature of the shed change.

31. A solenoid unit as claimed in claim 30, and wherein the solenoids are arranged in at least two parallel rows, and wherein the solenoids in each row are substantially equally spaced, one from another, and wherein a given row is laterally offset from an adjacent row of solenoids.

32. A solenoid unit as claimed in claim 31, further comprising an electrical coupling mounted in current conducting relation between the solenoids and the controller, and which allows the solenoid unit to be easily disconnected from the controller.

33. A solenoid unit as claimed in claim 32, and wherein the support member has a first side and an opposite second side, and wherein the solenoids are mounted on the first side, and wherein the second side is disposed in juxtaposed relation relative to the frame.

34. A solenoid unit as claimed in claim 32, and wherein at least two support members are releasably coupled to the frame, and wherein a plurality of solenoids are mounted on each support member.

35. A solenoid unit as claimed in claim 33, and wherein each solenoid coacts with two given latches.

36. A modular solenoid unit for use in a weaving device having a channel formed therein, the solenoid unit forming an easily detachable component thereof, comprising:

an elongated support member configured to slidably interlock with the channel of the weaving device; and a plurality of solenoids mounted in a given pattern on the support member;

a controller electrically coupled to the solenoids and controlling activation thereof; wherein the controller is electrically coupled to each of the solenoids, and wherein an electromagnetic field of energy is produced by a given solenoid as a result of the controller energizing the given solenoid by allowing electrical current to flow through the given solenoid.

37. A solenoid unit as claimed in claim 36, and wherein the solenoids are equally spaced in two rows.

38. A solenoid unit as claimed in claim 36, and wherein the solenoids are arranged in at least two parallel rows, and wherein the solenoids in each row are substantially equally spaced, one from another, and wherein the solenoids in a given row are offset from solenoids in the other row.

39. A solenoid unit as claimed in claim 38, and further comprising an electrical coupling mounted in current conducting relation between the solenoids and the controller, which allows the solenoid unit to be easily disconnected from the controller.

40. A solenoid unit as claimed in claim 39, and wherein the support member has a first side and an opposite second side, and wherein the solenoids are mounted on the first side.

41. A solenoid unit as claimed in claim 39, and wherein the channel in the weaving device is in the form of a dove-tail groove, and wherein the support member matingly engages the groove.

* * * * *